US006609271B2

(12) United States Patent
Kuo

(10) Patent No.: US 6,609,271 B2
(45) Date of Patent: Aug. 26, 2003

(54) LOCKING DEVICE FOR HANDLE ASSEMBLY WITH MULTIPLE STAGES

(75) Inventor: Chung-Hsien Kuo, Pan-Chiao (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 0 days.

(21) Appl. No.: 09/906,776

(22) Filed: Jul. 18, 2001

(65) Prior Publication Data

US 2003/0014841 A1 Jan. 23, 2003

(51) Int. Cl.[7] ..... B65D 25/28; A45F 5/10; E05B 1/00

(52) U.S. Cl. ..... 16/113.1; 16/405; 16/249; 280/655.1

(58) Field of Search ..... 16/113.1, 405, 16/249; 280/655.1, 655, 47.371, 47.17; 190/115, 18 A

(56) References Cited

U.S. PATENT DOCUMENTS 5,459,908 A * 10/1995 Chen ..... 16/113.1
5,581,846 A 12/1996 Wang ..... 16/115
5,628,088 A 5/1997 Chen ..... 16/115
5,639,109 A * 6/1997 Liang ..... 16/113.1
5,653,319 A * 8/1997 Wang ..... 16/113.1
5,694,663 A * 12/1997 Tserng ..... 16/113.1
5,727,898 A * 3/1998 Lu ..... 16/113.1
5,806,143 A * 9/1998 Tsai ..... 280/655.1
5,909,760 A * 6/1999 Tsai ..... 16/429
6,405,407 B1 * 6/2002 Chen ..... 16/113.1

FOREIGN PATENT DOCUMENTS

CN 362404 6/1999
CN 368815 9/1999

* cited by examiner

*Primary Examiner*—Thomas B. Will
*Assistant Examiner*—Tara L. Mayo
(74) *Attorney, Agent, or Firm*—Troxell Law Office PLLC

(57) ABSTRACT

A locking device for handle assembly with multiple stages wherein a lock member of higher lock may move into the lock hole of the next lower lock for causing a lock pin of the next lower lock to disengage. Further, there is no horizontal component force created on the slope because the lock member of the higher lock inserts into the lock hole of next lower lock as well as higher lock and next lower lock are engaged in a planar surface. This ensures that there is no gap between the higher and next lower lock such that the fully retracted handle grip may rest on the bezel.

18 Claims, 10 Drawing Sheets

LOCKING DEVICE FOR HANDLE ASSEMBLY WITH MULTIPLE STAGES

BACKGROUND OF THE INVENTION

1. Field of the Invention

The present invention relates to a locking device for a retractable handle of wheeled luggage and more particularly to such a locking device for handle assembly with multiple stages.

2. Description of Related Art

Typically, a single locking device is provided in the retractable handle for controlling the handle in a retracted position and an extended position. That is, the retractable handle may be extended to a maximum length when towing on the ground by traveler as well as retracted into a minimum length (i.e., rested on the top of luggage) appropriate for stowage or transport. It is known that luggage equipped with a retractable handle is very popular among travelers. Thus many types of luggage with retractable handle are commercially available in which most of the retractable handles are two stages, i.e., the handle either in a retracted position with minimum length or in an extended position with maximum length. This may be found in the disclosure of U.S. Pat. No. 5,581,846. A few of the retractable handles have a multiple retaining slots design. This may be found in the disclosure of U.S. Pat. No. 5,628,088. The multiple retaining slots design aims at providing a variable handle length when towing along the ground in order to accommodate different heights of people. However, it is also found that luggage have a variety of sizes and heights. The multiple retaining slots design can not completely solve the problems associated with two stages handle. This is because an optimum retractable handle should comply with a plurality of factors such as sex, age, and height of user in no connection with whether retractable handle is two stages or has multiple retaining slots as detailed below.

Various designs of locking devices for handle assembly with multiple retaining slots have been found in a search as follows: Taiwanese Patent Published No. 362,404 entitled "Activation Mechanism for Retractable Handle with Multiple Retaining Slots of Luggage" and No. 368,815 entitled "Improved Activation Mechanism for Retractable Handle with Multiple Retaining Slots of Luggage". But these are unsatisfactory for the purpose for which the invention is concerned for the following reasons:

1. Complex in components, for example, an additional central member 19, a lower positioning member 63 of sub-assembly 60, and other associated members are provided.
2. Time consuming in assembly.
3. A horizontal component force is applied on the slope when lock blocks (or pins) are activated by slanted guide groove. This causes additional drawbacks in addition to those described above. In detail, the ratio of extendible maximum length to retractable minimum length is significantly lowered due to the implementation of multiple-segment longitudinal slanted guide groove. This limits the effective length of extended handle. Thus improvement is desirable.

SUMMARY OF THE INVENTION

It is therefore an object of the present invention to provide a locking device for handle assembly with multiple stages for significantly increasing the ratio of extendible maximum length to retractable minimum length of handle such that a predetermined extendible length is achievable.

It is another object of the present invention to provide a locking device for handle assembly with multiple stages wherein lock member of first locking means is provided at the bottom of first housing of the first locking means capable of directly moving into the lock hole of the second locking means so as to cause lock pin of the second locking means to become disengaged; and lock member of second locking means is capable of directly moving into the lock hole of the third locking means so as to cause lock pin of the third locking means to become disengaged. As such, lock member of higher locking means is capable of directly moving into the lock hole of the next lower locking means so as to cause lock pin of the next lower locking means to become disengaged. Further, there is no horizontal component force created on the slope as occurred in the prior art because the lock member of the higher locking means directly inserts into the lock hole of next lower locking means as well as higher locking means and next lower locking means are engaged in a planar surface. This ensures that there is no gap between the higher and next lower locking means such that the handle grip of the fully retracted handle may rest on the bezel.

To achieve the above and other objects, the present invention provides a locking device for handle assembly with multiple stages comprising:

a first sliding tube; a first locking means detachably attached to the bottom of the first sliding tube; a second sliding tube for allowing the first sliding tube to slidingly move therein having an upper hole and a lower hole; a second locking means detachably attached to the bottom of the second sliding tube; a third sliding tube for allowing the second sliding tube to slidingly move therein having an upper hole and a lower hole; a third locking means detachably attached to the bottom of the third sliding tube; a support tube for allowing the third sliding tube to slidingly move therein having an upper hole and a lower hole; and a first connecting means connected between a push button and the first locking means.

Whereby the handle is retracted when the push button is not pressed, the first sliding tube is received in the second sliding tube, the second sliding tube is received in the third sliding, the third sliding tube is received in the support tube, the lock projection of the first locking means is engaged with the lower hole of the second sliding tube, the bottom of the first locking means is biased against the top of the sliding block of the second locking means so as to move the lock member of the first locking means into the lock hole of the second locking means to cause the first end of the lock pin of the second locking means to retract into the third sliding tube, the second end of the lock pin of the second locking means to extend into the lower hole of the third sliding tube, the bottom of the second locking means is biased against the top of the sliding block of the third locking means so as to move the lock member of the second locking means into the lock hole of the third locking means to cause the first end of the lock-pin of the third locking means to retract into the support tube, and the second end of the lock pin of the third locking means to extend into the lower hole of the support tube, whereby the handle is locked in a retracted position.

The push button is pressed. Then handle is pulled upward to cause the first locking means to move up so as to move the lock pin of the first locking means into lower hole of the second sliding tube. Grasp handle grip to pull first sliding tube upward so as to move the lock pin of the second locking means into the upper hole of the third locking means for disengaging the lock member on the bottom of first locking means from lock hole of the second locking means. Then the second end of the lock pin of the second locking means retracts to become disengaged to cause the second locking means to move up as the second sliding tube and the first sliding tube move up together until the second lock pin comes into contact with upper hole of the third sliding tube and locks therein. At the same time, the lock member on the bottom of second locking means disengages from the lock hole of the third locking means. Then the second end of the lock pin of the second locking means retracts to become disengaged to cause the third locking means to move up as the third sliding tube and the second sliding tube move up together until the third lock pin comes into contact with upper hole of the support tube and locks therein. Now handle is in a fully extended position for allowing luggage to be towed along the ground.

In one aspect of the invention the locking device for handle assembly with multiple stages is provided wherein the locking device comprises a longitudinal lock hole, a lateral lock hole, and a lock pin at the bottom. Further, longitudinal lock hole and lateral lock hole are in communication each other. Longitudinal lock hole has a lock block being movable to either right or left to lock thereto. As such, lock block is locked in upper hole of the corresponding tube when handle is pulled up to its maximum length, while lock block is locked in lower hole of the corresponding tube when handle is pushed down to its minimum length.

The above and other objects, features and advantages of the present invention will become apparent from the following detailed description taken with the accompanying drawings.

DETAILED DESCRIPTION OF THE PREFERRED EMBODIMENTS

Figure 1:
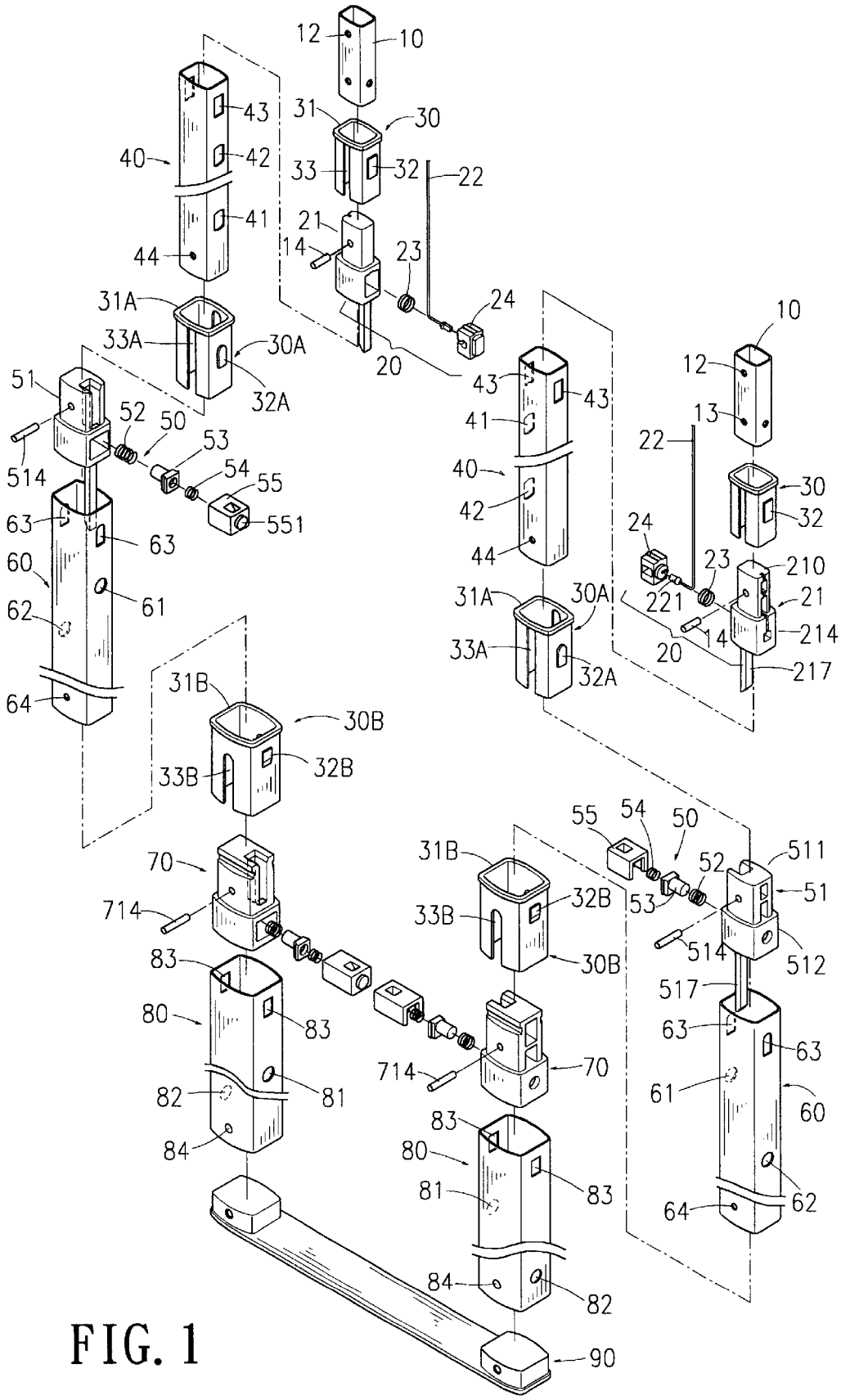
FIG. 1 is an exploded perspective view of a first embodiment of a locking device for handle assembly with multiple stages of wheeled luggage of the invention.

Referring to FIGS. 1–6, there is shown a locking device for handle assembly of wheeled luggage constructed in accordance with the first embodiment of the invention wherein handle assembly is provided on the back of luggage with a handle grip H and a push button B received in a bezel on top of luggage.

Note that because the handle system is bilaterally symmetrical so that description of one side serves to describe the entirety. Thus the handle system of the invention comprises: a first sliding tube 10 having a lower hole 13 and an upper hole 12 attached to one end of handle grip H by a known fastener; a first locking means 20 detachably attached to the bottom of first sliding tube 10 by a pin 14; a second sliding tube 40 for allowing first sliding tube 10 to slidingly move therein having a top and lower holes 41 and 42 on a first side, left and right apertures 43, and pin holes 44 on either top or bottom side; a first sleeve member 30 provided on the top of second sliding tube 40 having two detents 32 provided on two opposing sides matingly engaged with left and right apertures 43 of second sliding tube 40; a second locking means 50 detachably attached to lower pin hole 44 of the second sliding tube 40 by a pin 514; a third sliding tube 60 for allowing second sliding tube 40 to slidingly move therein having a top and lower holes 61 and 62 on a first side, two apertures 63 on either second or third side, and pin holes 64 on either top or bottom side; and a second sleeve member 30A provided on the top of third sliding tube 60 having two detents 32A provided on two opposing sides matingly engaged with apertures 63 of third sliding tube 60; a third locking means 70 detachably attached to lower pin hole 64 of the third sliding tube 60 by a pin 714; a support tube 80 for allowing the third sliding tube 60 to slidingly move therein having an upper hole 81 and a lower hole 82 on a first side, two apertures 83 on either second or third side at the top portion, and pin holes 84 on bottom side; a third sleeve member 30B provided on the top of support tube 80 having two detents 32B provided on two opposing sides matingly engaged with apertures 83 of support tube 80; and a support 90 provided at the bottom of support tube 80 being secured to pin holes 84 of support tube 80.

Figure 2:
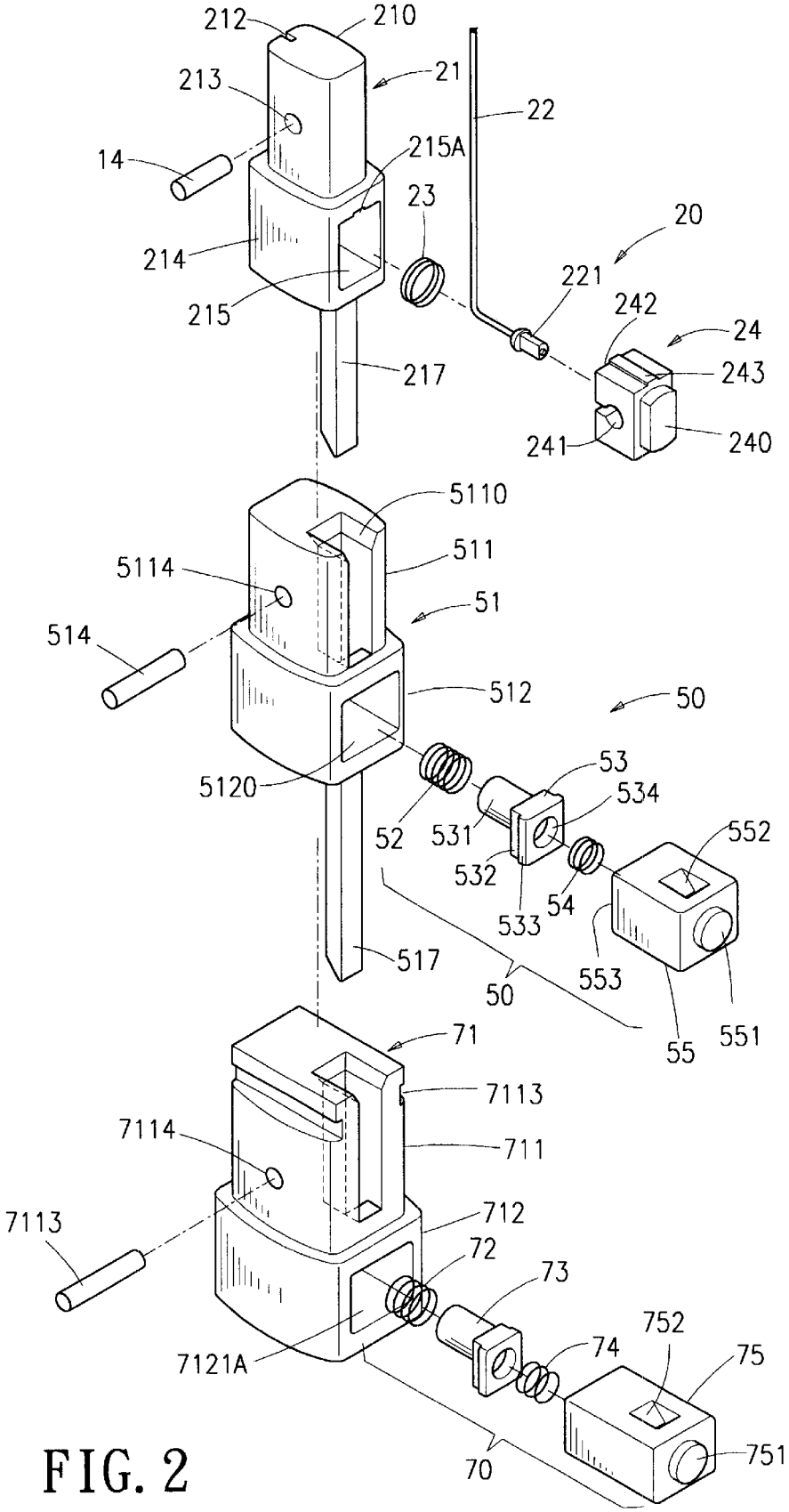
FIG. 2 is a greatly enlarged fragmentary view showing the first, second, and third locking means of FIG. 1.
Figure 3:
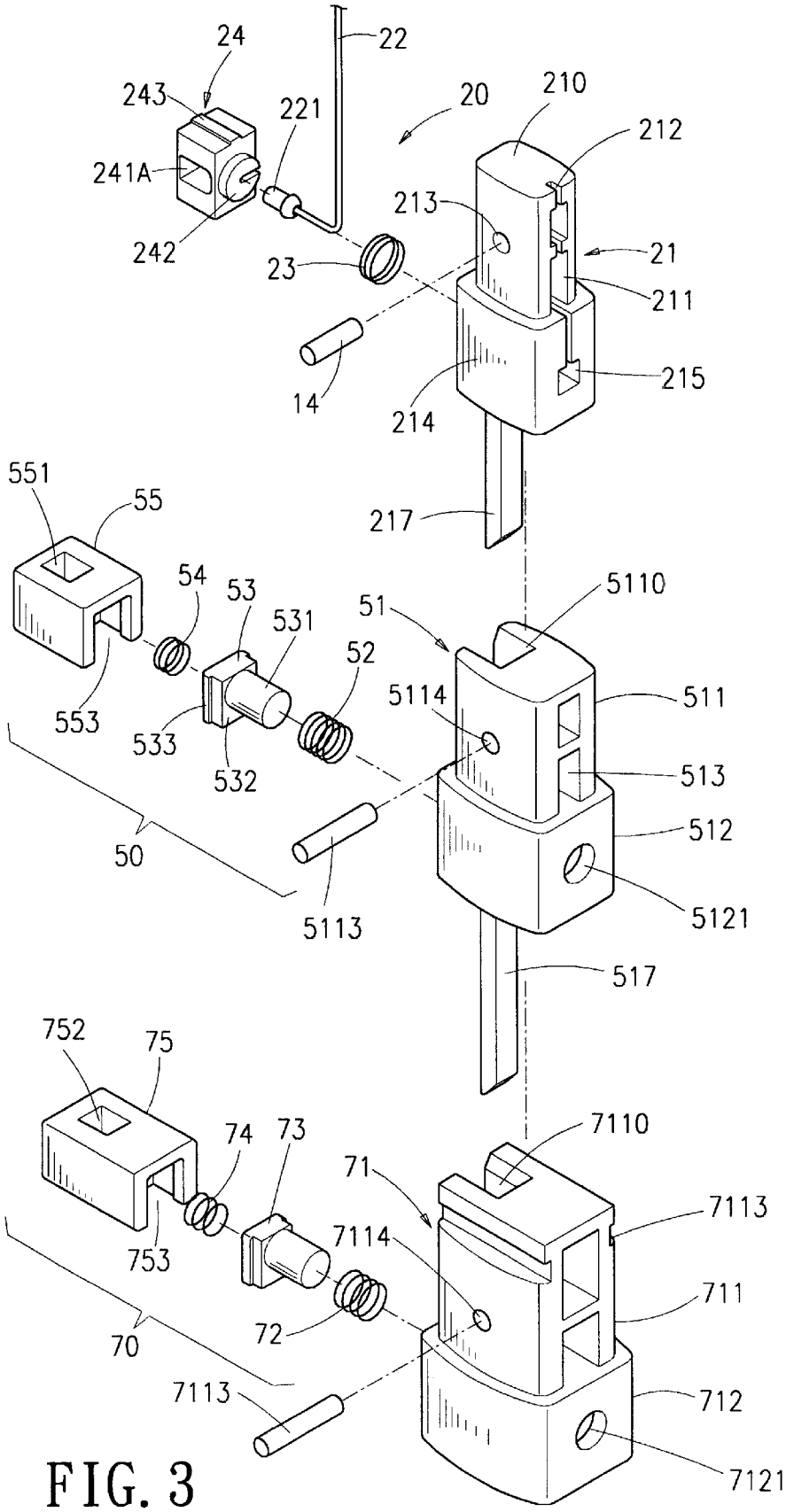
FIG. 3 is another greatly enlarged fragmentary view showing the first, second, and third locking means of FIG. 1.

As shown in FIGS. 2 and 3, the first locking means 20 comprises a first housing 21 having an upper portion 210 with a guide groove 212 and a pin hole 213 such that pin 14 may insert through lower hole 13 of first sliding tube 10 and pin hole 213 to secure first locking means 20 and first sliding tube 10 together; and a lower portion 214 with a cavity 215; a spring 23 provided in the cavity 215 of first housing 21; a lock block 24 provided in the cavity 215 of first housing 21 having a lock projection 240 on a first side, a split aperture 241 on a second side, an aperture 241A in communication with the aperture 241, an elongate protrusion 243 on the top of lock block 24 being matingly engaged with internal elongate groove 215A on top of cavity 215 of first housing 21; a lock member 217 provided on the bottom of first housing 21; and a steel cable 22 having an enlargement on one end (not shown) being secured to handle grip H and an enlargement 221 on the other end being secured in the aperture 241A through the guide groove 212, cavity 215 (FIG. 3), and aperture 241 such that a pressing of the push button B may be transmitted to first locking means 20 through the movement of steel cable 22.

The second locking means 50 comprises a second housing 51, springs 52 and 54, sliding lock block 53 having a sliding block 532 and a second lower lock pin 531, and second lock block 55 having a second upper lock pin 551, a second lower lock hole 552, a lock member 517 provided on the bottom of second housing 51, and a groove 553 wherein the upper portion of the second housing 51 having a plurality of longitudinal lock holes 5110, upper lock hole 5111 (FIG. 4), recess 513, and pin hole 5114 wherein longitudinal lock holes 5110 are in communication with upper lock hole 5111, pin 514 is received in hole 5114 for securing second housing 51 to lower pin hole 44 of second sliding tube 40 (FIG. 1), lower portion 512 of second housing 51 receives lateral lock hole 5120 of second lock block 55, lateral lock hole 5120 is in communication with longitudinal lock hole 5110 and upper lock hole 5111, groove 553 receives spring 54 and sliding lock block 53, a projection 533 is protruded on sliding block 532 of sliding lock block 53, the projection 533 conforms with groove 553 while larger than the mouth of groove 553 as such projection 533 can be inserted in groove 553 from the open bottom, a circular recess 534 (FIG. 2) is provided on the other side of projection 533 for receiving spring 54 therein such that lock pin 531 is always protruded by the expansion of spring 54, second upper lock pin 551 is protruded when spring 52 is put on second lower lock pin 531, while second upper lock pin 551 is retracted when lock member 217 is inserted in second lower lock hole 552 as detailed below.

Figure 4B:
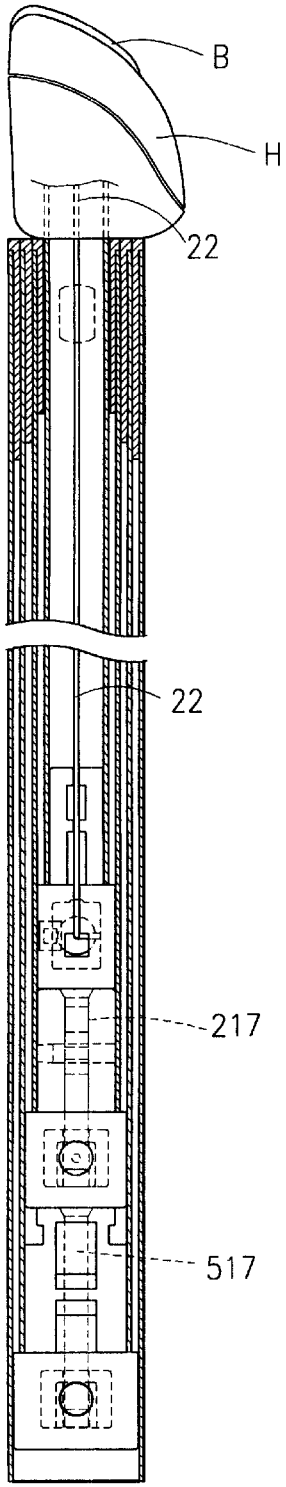
FIGS. 4A and 4B are first and second sectional views of first to third locking means where handle is fully retracted.
Figure 4A:
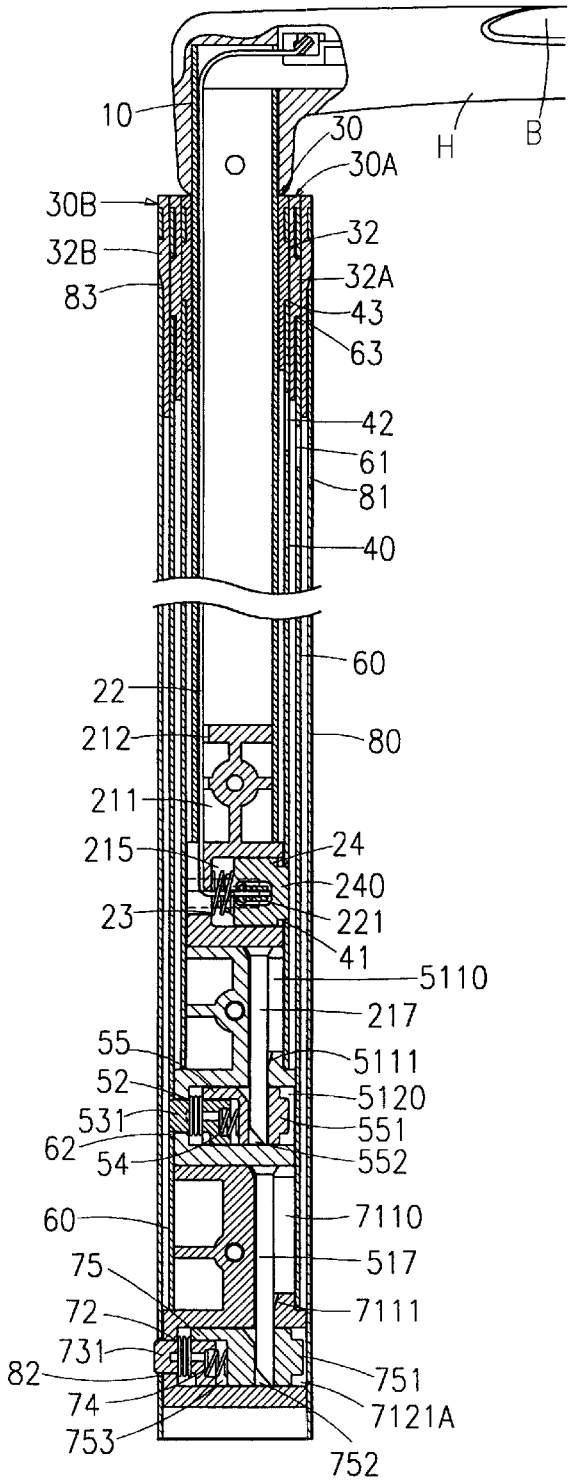

Handle is retracted when push button B is not pressed (FIGS. 4A and 4B). First sliding tube 10 is received in second sliding tube 40, second sliding tube 40 is received in third sliding tube 60, and third sliding tube 60 is received in support tube 80. Projection 240 of lock block 24 of first locking means 20 at the bottom of first sliding tube 10 is biased by spring 23 to engage with lower hole 47 of second sliding tube 40. The lock member 217 at the bottom of the first locking means 20 is engaged with the longitudinal lock hole 5110 and upper lock hole 5111 of second locking means 50 so as to retract second upper lock pin 551 of the lock block 55 of the second locking means 50 into the third sliding tube 60. Similarly, second lower lock pin 531 of the second locking means 50 is engaged with the lower hole 62 of third sliding tube 60 so as to retract third upper lock pin 751 of the third locking means 70 to cause third lower lock pin 731 to engage with lower hole 82 of support tube 80. Whereby the handle is locked in a retracted position (FIGS. 4A and 4B).

Figure 5:
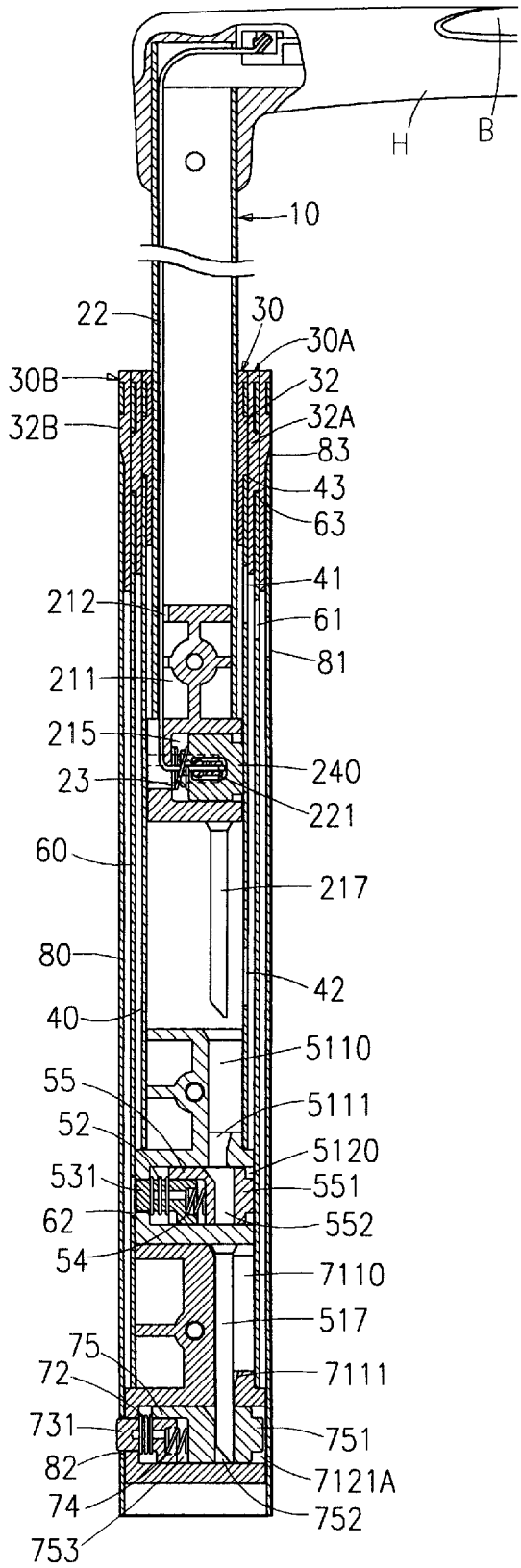
FIG. 5 is similar to FIG. 4 where second locking means disengages from first locking means while handle is pulling up.
Figure 6B:
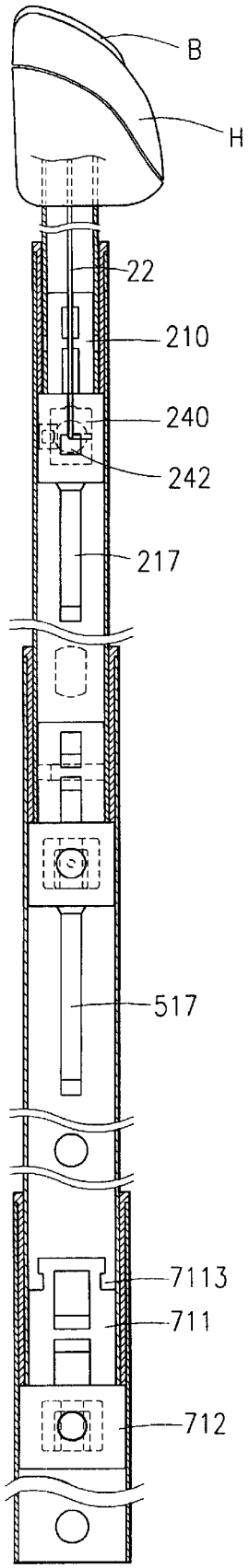
FIGS. 6A and 6B are first and second sectional views of first to third locking means where handle is extended to its maximum length.
Figure 6A:
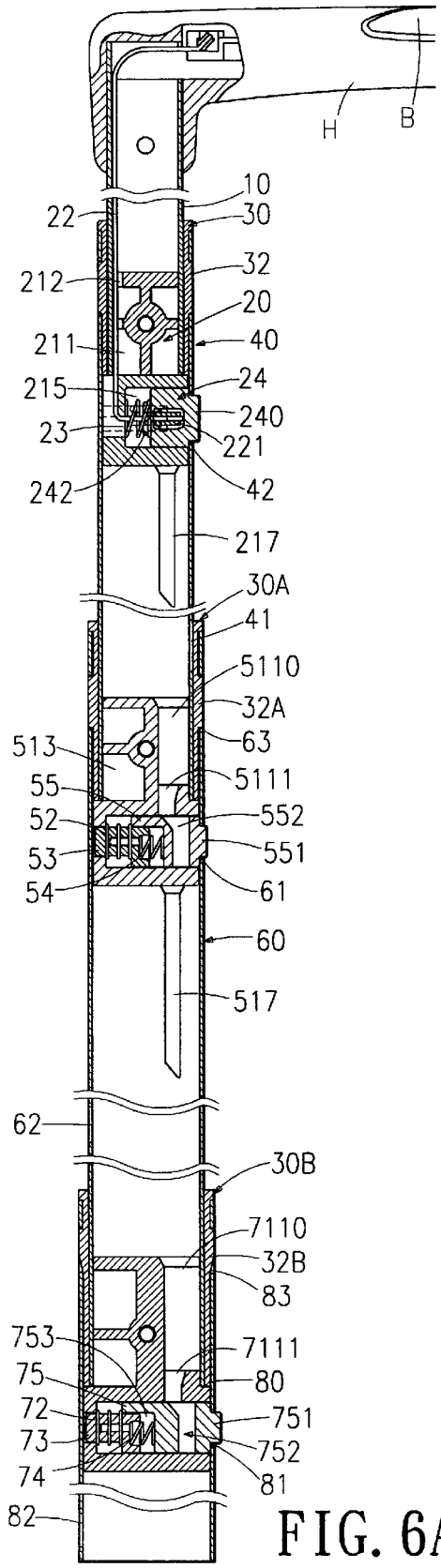
Figure 7:
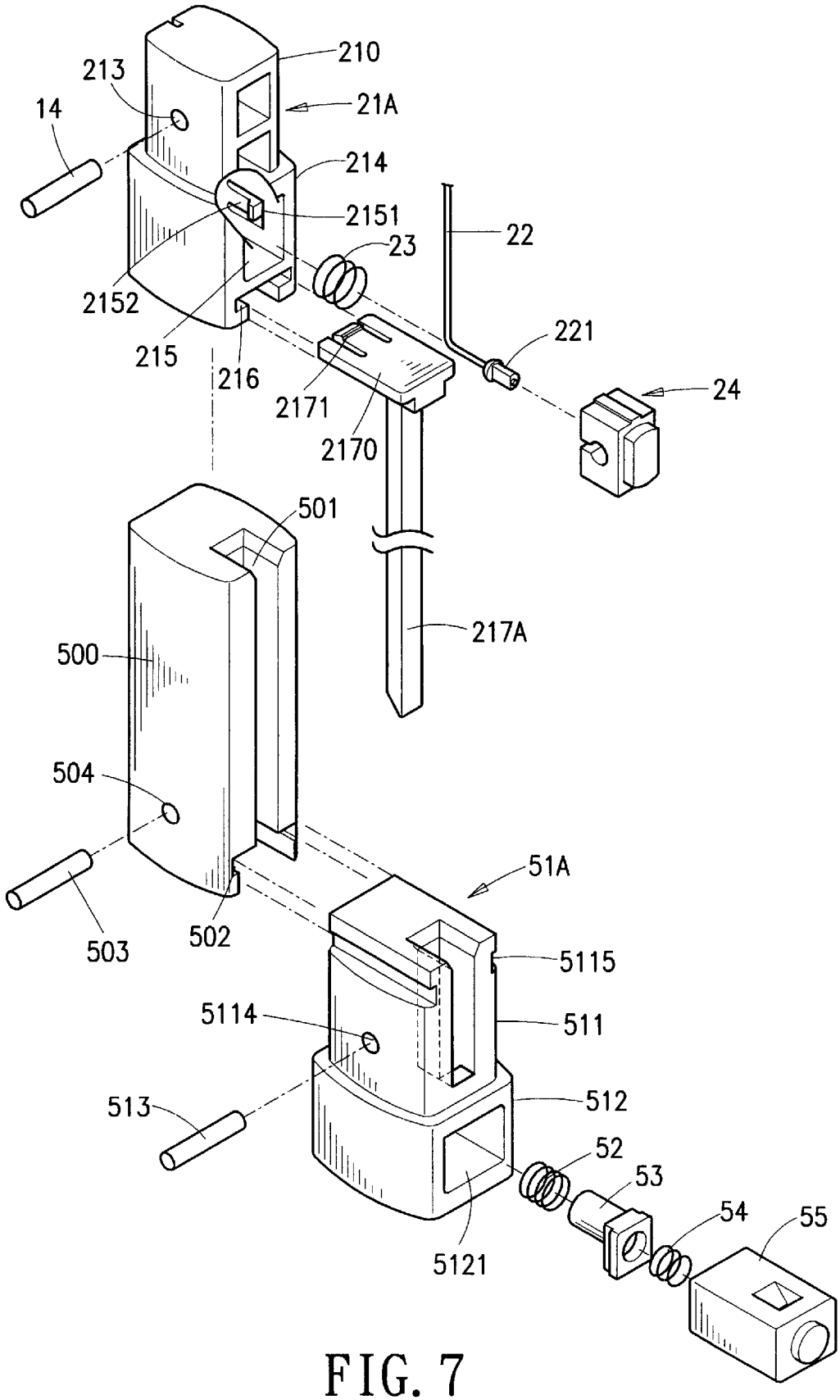
FIG. 7 is an exploded perspective view of a second embodiment of a locking device for handle assembly with multiple stages of wheeled luggage of the invention.

First press the push button B. Then handle is pulled upward. That is, steel cable 22 of the first locking means 20 is moved up so as to bias spring 23 of the first locking means 20. Further, the lock projection 240 of lock block 24 clears lower hole 42 of second sliding tube 40 (FIG. 5). As such, grasp handle grip to pull first sliding tube 10 upward for separating the lock member 217 at the bottom of first locking means 20 from lower lock hole 552 of the second locking means 50. Then second upper lock pin 551 of the second locking means 50 extends outwardly to come into contact with the inner wall of third sliding tube 60. Once first sliding tube 10 is not able to pull up along the second sliding tube 40 any more, second sliding tube 40 begins to move up so as to move second locking means 50 up to the position of second upper lock pin 551. At the same time, first sliding tube 10 begins to pull up again until projection 240 of lock block 24 of first locking means 20 comes into upper hole 41 of the second sliding tube 40 to lock therein. Similarly, second sliding tube 40 and third sliding tube 60 move up sequentially until second upper lock pin 551 of second locking means 50 comes into upper hole 61 of the third sliding tube 60, and second upper lock pin 751 of third locking means 70 comes into upper hole 81 of the support tube 80 to lock therein both. Now handle is in a fully extended position for allowing luggage to be towed along the ground (FIGS. 6A and 6B). To the contrary, press push button B to retract handle which in turn causes pin 240 of lock block 24 attached to cable 22 to escape engagement with upper hole 41 of second sliding tube 40. Whereby first sliding tube 10 may receive within second sliding tube 40 until lock member 217 at the bottom of first locking means 20 comes into contact with the lock hole 552 of the second locking means 50. This causes second upper lock pin 551 of second locking means 50 to clear upper hole 61 of third sliding tube 60. Also, lock pin 751 of third upper lock block 75 of third locking means 70 clears upper hole 81 of support tube 80 when push button is pressed again. As such, first sliding tube 10 may receive in second sliding tube 40, second sliding tube 40 may receive in third sliding tube 60, and third sliding tube 60 may receive in support tube 80. Now the handle is fully retracted (FIGS. 4A and 4B).

Note that the first locking means 20 is a master means, while second and third locking means 50 and 70 are slave means (i.e., there are two slave means in this embodiment). As such, the number of slave means may increase or decrease in other embodiments based on needs. Further, the number of sliding tubes may increase or decrease too. As a result, a handle assembly with multiple locking means and a plurality of constituent tubes are carried out, thereby enabling handle to extend and lock in one of a plurality of selective positions thereof.

Figure 8:
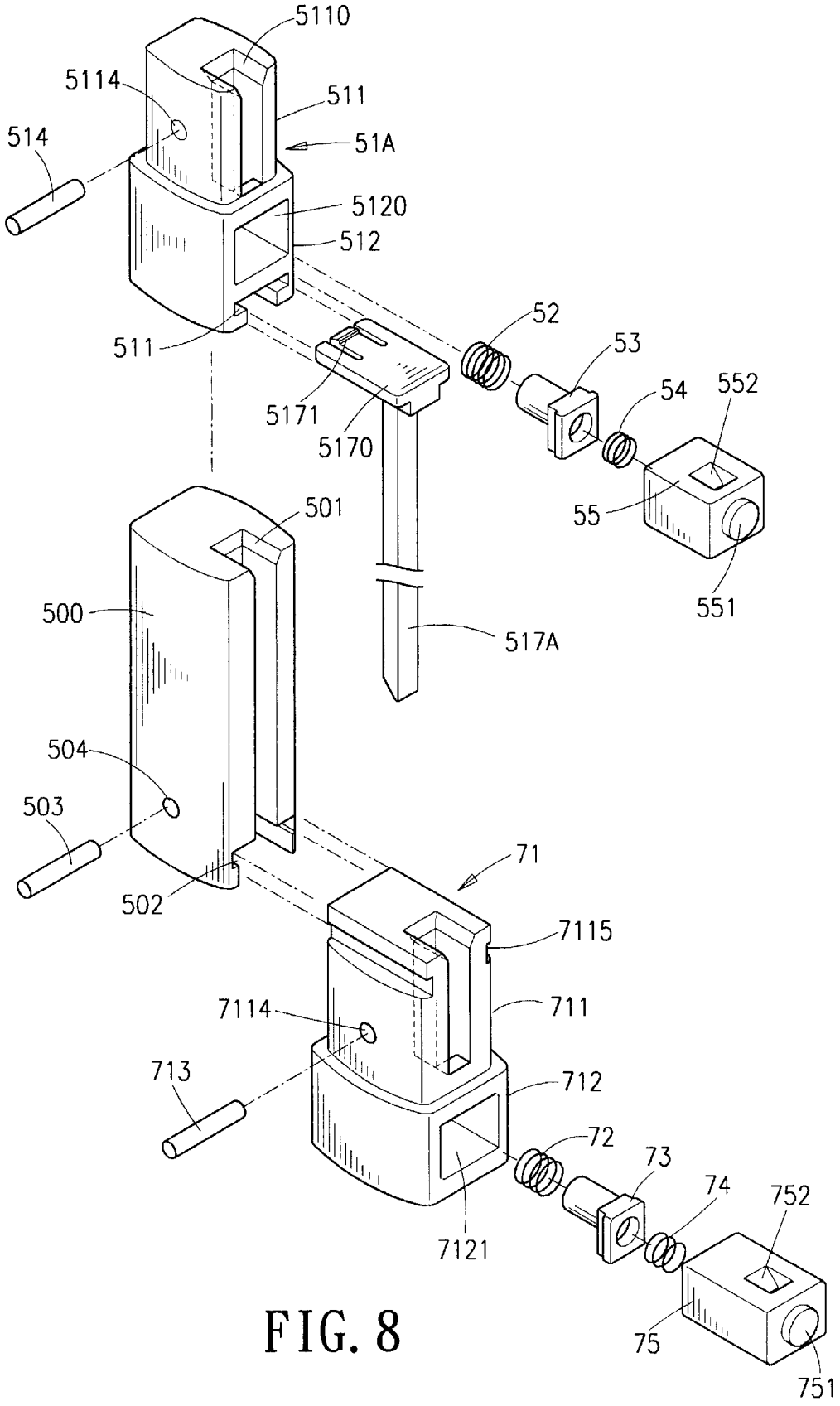
FIG. 8 is an exploded view of a third embodiment of a locking device for handle assembly with multiple stages of wheeled luggage of the invention.
Figure 9:
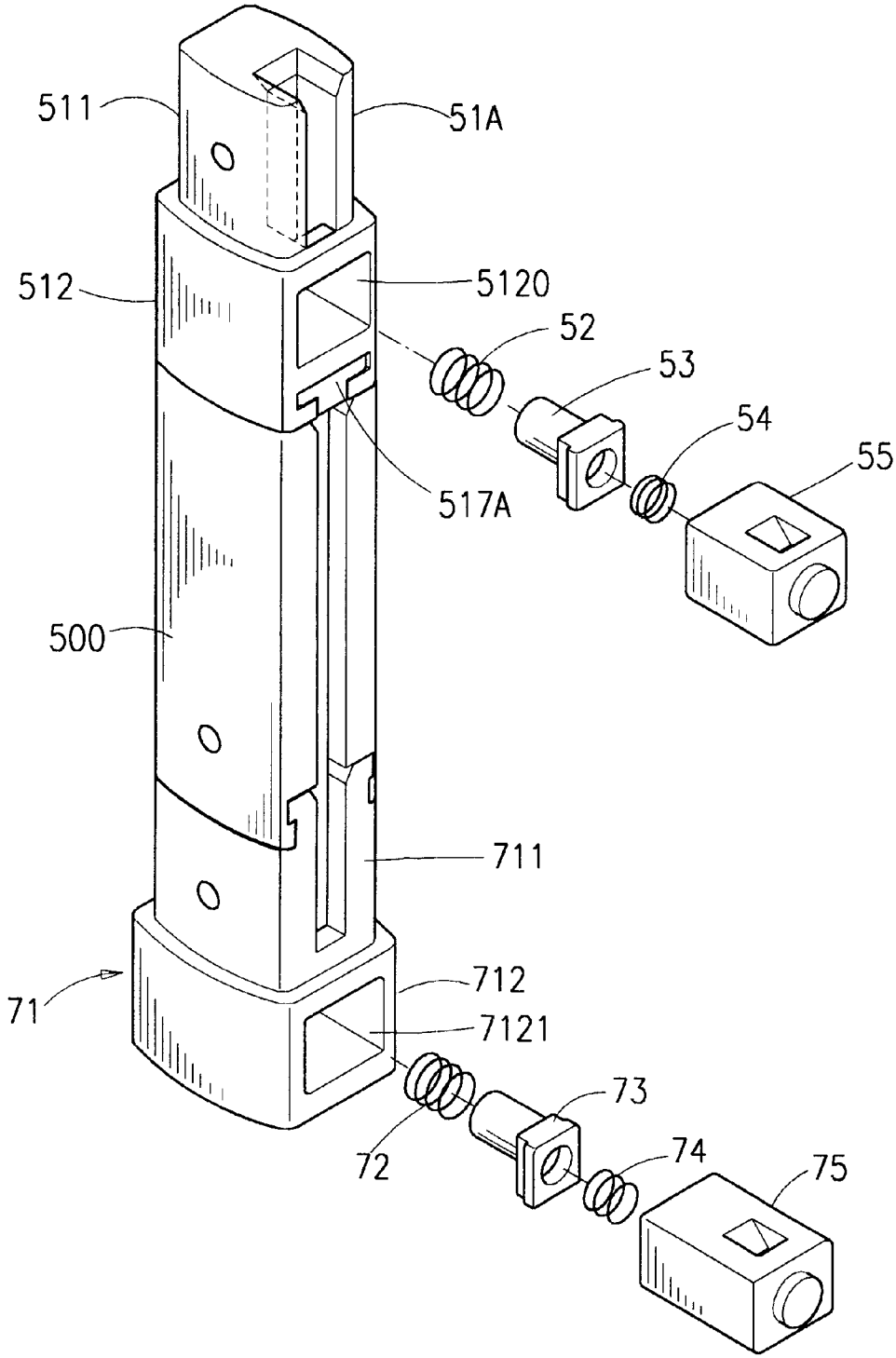
FIG. 9 is a perspective view showing the assembled locking device shown in FIG. 8.
Figure 11:
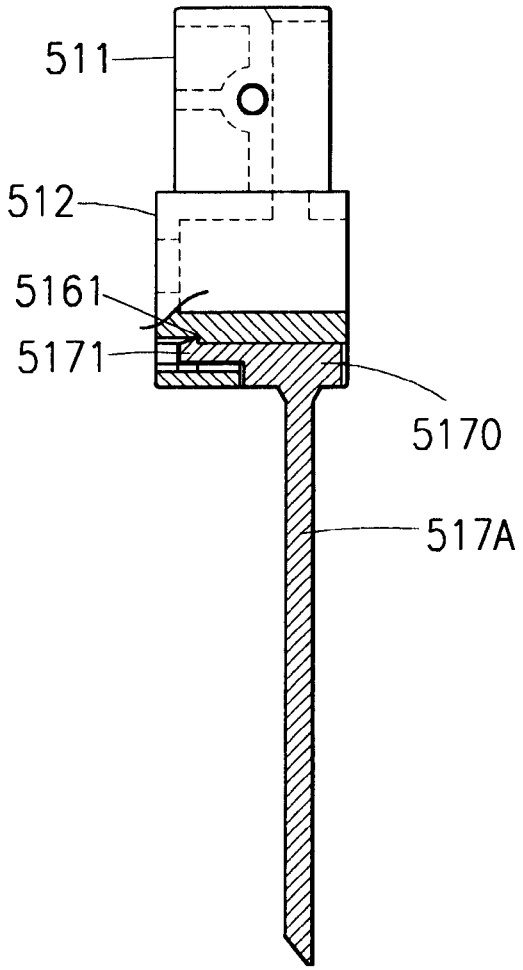
FIG. 11 is a sectional view of second locking means of FIG. 8.
Figure 10:
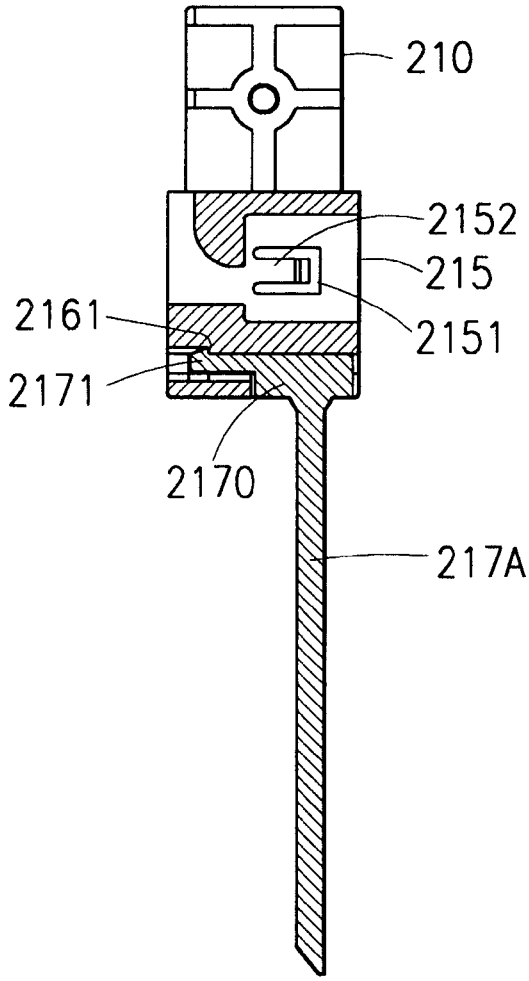
FIG. 10 is a sectional view of first locking means of FIG. 7.

A second embodiment of locking device of the invention is illustrated in FIGS. 7–10. As shown, housing 21A first locking means 20 and lock pin 217A are separately formed. For assembling these components, a groove 216 is provided in the bottom of housing 21A, a tab 2161 (FIG. 10) is provided within groove 216, a rectangular planar member 2170 is provided on top of lock pin 217A, and a flexible tab 2171 is provided in the front side facing housing 21A. In assembly, directly insert rectangular planar member 2170 into groove 216 of housing 21A to cause flexible tab 2171 to matingly secure to tab 2161 to finish the assembly (FIG. 10). To further secure the lock block 24 to the cavity 215, a lock projection 2151 with finger 2152 is provided on one inner side of cavity 215 so as to lock the recess (not shown) on side portion of the lock block 24 to cause the flexible projection 2151 to matingly secure to the recess to easily finish assembly.

Two lateral outer groove 5115 are provided on either side of upper portion 511 of second housing 51 and two corresponding inner lateral grooves 502 are provided on two sides of lower portion of the protective member 500 and a longitudinal groove 501 is also provided on the protective member 500 so as to protect upper portions 210 and 511 of housings 21A and 51A from being deformed caused by force exerted by engaged handle thereon which may neutralize the locking capability of the locking device. As such, the protective member 500 may secure first and second locking means 20 and 50 together for protecting second housing 51 from being deformed due to exerted force as well as causing longitudinal groove 501 to provide a protection thereto when lock pin 217A is prolonged, thereby providing a normal unlocking capability. Note that the description of other components is the same as that of first embodiment and thus a detailed description is omitted herein for the sake of brevity.

A third embodiment of locking device of the invention is illustrated in FIGS. 8–10. As shown, housing 51A of second locking means 50 is made the same as first housing 21A of second embodiment. For example, a groove 516 is provided at the bottom of second housing 51A, a rectangular planar member 5170 and a flexible tab 5171 are provided in lock pin 517A, and a protective member 500. These components have the same functionalities as that shown in second embodiment. Thus a detailed description thereof is omitted herein for the sake of brevity. Note that protective member 500 is provided on second housing 51A in the second embodiment, while protective member 500 is provided on third housing 71 in the third embodiment. The protective member 500 serves as a protection to the housing from being deformed caused by exerted force when handle is pulled or pushed.

While the invention herein disclosed has been described by means of specific embodiments, numerous modifications and variations could be made thereto by those skilled in the art without departing from the scope of the invention set forth in the claims.

What is claimed is:

1. A handle assembly provided on a luggage having a handle including a push button received in a recessed portion on the top of the luggage, either side of the handle assembly comprising:

a first sliding tube;

a first locking means having a first housing detachably attached to a bottom of the first sliding tube;

a second sliding tube allowing the first sliding tube to slidingly move therein and having an upper hole and a lower hole;

a second locking means having a second housing detachably attached to a bottom of the second sliding tube;

a third sliding tube allowing the second sliding tube to slidingly move therein and having an upper hole and a lower hole;

a third locking means detachably attached to a bottom of the third sliding tube;

a support tube allowing the third sliding tube to slidingly move therein and having an upper hole and a lower hole; and a first connecting means connected between the push button and the first locking means;

whereby, when the handle is retracted and the push button is not pressed, the first sliding tube is received in the second sliding tube, the second sliding tube is received in the third sliding tube, the third sliding tube is received in the support tube, a lock projection of the first locking means is engaged with the lower hole of the second sliding tube, a bottom of the first locking means is biased against a top of a sliding block of the second locking means so as to move a lock member of the first locking means into a lock hole of the second locking means to cause a first end of a lock pin of the second locking means to retract into the third sliding tube, a second end of a lock pin of the second locking means to extend into the lower hole of the third sliding tube, a bottom of the second locking means is biased against a top of a sliding block of the third locking means so as to move a lock member of the second locking means into a lock hole of the third locking means to cause a first end of a lock pin of the third locking means to retract into the support tube, and a second end of the lock pin of the third locking means to extend into the lower hole of the support tube, whereby the handle is locked in a retracted position;

wherein when the push button is pressed, the lock projection of the first locking means is retracted into the second sliding tube, the handle is pulled upward to cause the first locking means to move up so as to move the lock projection of the first locking means into the upper hole of the second sliding tube, when the handle grip is further pull the first sliding tube upward to disengage the lock member on the bottom of the first locking means from the lock hole of the second locking means, the second end of the lock pin of the second locking means retracts to become tube and the first sliding tube move up together until the first end of the lock pin of disengaged to cause the second locking means to move up as the second sliding second locking means comes into contact with the upper hole of the third sliding tube and locks therein, the lock member on the bottom of the second locking means disengages from the lock hole of the third locking means, the second end of the lock pin of the third locking means retracts to become disengaged to cause the third locking means to move up as the third sliding tube and the second sliding tube move up together until the first end of the lock pin of third locking means comes into contact with the upper hole of the support tube and locks therein, and the handle is in a fully extended position.

2. The handle assembly of claim 1, wherein the second locking means comprises the second housing, a first spring received in the second housing, a sliding lock block, a second spring provided on the sliding lock block, a second lock block, and a lock member provided in the bottom of the second housing.

3. The handle assembly of claim 2, wherein the upper portion of the second locking housing includes a projection conformed to the bore of the second sliding tube for engaging with the bottom of the second sliding tube.

4. The handle assembly of claim 2, wherein the lower portion of the second locking means includes a lateral groove for receiving the second lock block, a longitudinal lock hole being in communication with the lateral groove, a lock pin for putting the spring thereon in one end, and the lock pin in the other end receivable in the upper hole of third sliding tube.

5. The handle assembly of claim 1, wherein the first locking means comprises a first housing with a cavity having a spring provided therein, a lock block having a lock projection provided in the cavity of the first locking means, and a lock member provided in the bottom of the first housing.

6. The handle assembly of claim 1, wherein the first locking means is a master member and the second and third locking means are slave members controlled by the first locking means.

7. The handle assembly of claim 1, wherein the lock member provided in the bottom of each of the locking means is formed separately from the housing thereof prior to assembling.

8. The handle assembly of claim 1, wherein the upper portion of each of the locking means further comprises a protective member being engaged with the housing of each of the locking means for protecting the housing of each of the locking means from being deformed caused by force exerted by an engaged handle thereon.

9. A handle assembly provided on a luggage having a handle including a push button received in a recessed portion on the top of the luggage, either side of the handle assembly comprising:

a first sliding tube;

a first locking means detachably attached to the bottom of the first sliding tube;

a second sliding tube for allowing the first sliding tube to slidingly move therein having an upper hole and a lower hole;

a second locking means detachably attached to the bottom of the second sliding tube;

a support tube for allowing the third sliding tube to slidingly move therein having an upper hole and a lower hole; and a first connecting means connected between the push button and the first locking means;

whereby the handle is retracted when the push button is not pressed, the first sliding tube is received in the second sliding tube, the second sliding tube is received in the support tube, a lock projection of the first locking means is engaged with the lower hole of the second sliding tube, a bottom of the first locking means is biased against a top of a sliding block of the second locking means so as to move a lock member of the first locking means into a lock hole of the second locking means to cause the first end of a lock pin of the second locking means to retract into the lower hole of the support tube, whereby the handle is locked in a retracted position;

wherein when the push button is pressed, the lock projection of the first locking means is retracted into the second sliding tube, the handle is pulled upward to cause the first locking means to move up so as to move the lock projection of the first locking means into the upper hole of the second sliding tube, when the handle grip is further pull the first sliding tube upward to disengage the lock member on the bottom of the first locking means from the lock hole of the second locking means, the second locking means to move up as the second sliding tube and the first sliding tube both move up together until the first end of lock pin of the second locking means comes into contact with the upper hole of the second sliding tube and locks therein, and the handle is in a fully extended position.

10. The handle assembly of claim 9, wherein the second locking means comprises a second housing, a first spring received in the second housing, a sliding lock block, a second spring provided on the sliding lock block, a second lock block, and a lock member provided in the bottom of the second housing.

11. The handle assembly of claim 10, wherein the upper portion of the second locking housing includes a projection conformed to the bore of the second sliding tube for engaging with the bottom of the second sliding tube.

12. The handle assembly of claim 10, wherein the lower portion of the second locking means includes a lateral groove for receiving the second lock block and a longitudinal lock hole being in communication with the lateral groove.

13. The handle assembly of claim 9, wherein the first locking means comprises a first housing with a cavity having a spring provided therein, a lock block provided in the cavity of the first locking means, and a lock member provided in the bottom of the first housing.

14. The handle assembly of claim 9, wherein the first locking means is a master member and the second locking means is a slave member controlled by the first locking means.

15. The handle assembly of claim 9, wherein the lock member provided in the bottom of each of the locking means is formed separately from the housing thereof prior to assembling.

16. The handle assembly of claim 9, wherein the upper portion of each of the locking means further comprises a protective member being engaged with the housing of each of the locking means for protecting the housing of each of the locking means from being deformed caused by force exerted by engaged handle thereon.

17. A handle assembly provided on a luggage having a handle including a support tube, a sliding tube slidingly received in the support tube, and a push button received in a recessed portion on the top of the luggage, either side of the handle assembly including a locking device comprising a longitudinal lock hole, a lateral lock hole, and a lock pin at the bottom wherein the longitudinal lock hole and the lateral lock hole are in communication, the longitudinal lock hole has a lock block being movable to either right or left side to lock thereto, the lock block is locked in an upper hole of the support tube when the handle is pulled up to its maximum length, and the lock block is locked in a lower hole of the support tube when the handle is pushed down to its minimum length.

18. The handle assembly of claim 17, further comprising at least one slave member being controlled by the locking device and activated by the push button to form a multiple stage retractable handle.

* * * * *